US008863704B2

(12) United States Patent
Mehring et al.

(10) Patent No.: US 8,863,704 B2
(45) Date of Patent: Oct. 21, 2014

(54) LIQUID-COOLED INTERNAL COMBUSTION ENGINE AND METHOD FOR OPERATING AN INTERNAL COMBUSTION ENGINE OF SAID TYPE

(71) Applicant: Ford Global Technologies, LLC, Dearborn, MI (US)

(72) Inventors: Jan Mehring, Cologne (DE); Hans Guenter Quix, Herzogenrath (DE)

(73) Assignee: Ford Global Technologies, LLC, Dearborn, MI (US)

( * ) Notice: Subject to any disclaimer, the term of this patent is extended or adjusted under 35 U.S.C. 154(b) by 2 days.

(21) Appl. No.: 13/733,032

(22) Filed: Jan. 2, 2013

(65) Prior Publication Data

US 2013/0167786 A1 Jul. 4, 2013

(30) Foreign Application Priority Data

Jan. 2, 2012 (DE) ..... 10 2012 200 003

(51) Int. Cl.
*F02F 1/10* (2006.01)
*F01P 7/16* (2006.01)
*F01P 3/02* (2006.01)

(52) U.S. Cl.
CPC . *F02F 1/10* (2013.01); *F01P 7/165* (2013.01); *F01P 2003/027* (2013.01); *F01P 3/02* (2013.01)
USPC ..... 123/41.82 R; 123/90.1; 123/41.6; 123/41.16

(58) Field of Classification Search
CPC ..... F01P 2003/027; F01P 2003/028; F01P 2003/024; F01P 2003/021; F01P 2001/023; F02D 41/068
USPC ..... 123/41.8 R, 90.1, 41.16, 41.17, 41.44, 123/41.74
See application file for complete search history.

(56) References Cited

U.S. PATENT DOCUMENTS 4,319,547 A 3/1982 Bierling
5,894,834 A * 4/1999 Kim ..... 123/552
(Continued)

FOREIGN PATENT DOCUMENTS

DE 3317454 A1 11/1984
DE 10061546 A1 8/2002
(Continued)

OTHER PUBLICATIONS

Kobayashi, H. et al., "A Study on Dual Circuit Cooling for Higher Compression Ratio," SAE Technical Paper Series No. 841294, 1984, 8 pages.

*Primary Examiner* — Noah Kamen
*Assistant Examiner* — Long T Tran
(74) *Attorney, Agent, or Firm* — Greg Brown; Alleman Hall McCoy Russell & Tuttle LLP

(57) ABSTRACT

A liquid-cooling engine system is described with a coolant control device having an adjustable control element capable of independently controlling the flow of coolant through a cylinder head and cylinder block. The device contains a rotatable drum that can be rotated along its longitudinal axis to expose holes and thereby allows coolant circulation based on a temperature within the engine system. The coolant control device has three positions but may also be fine-tuned within each position to control the flow of coolant through the cylinder head and cylinder block in order to adjust the amount of heat extracted according to demand, which serves to control the liquid-type cooling circuit in a demand-dependent manner that accounts for the operating modes of the internal combustion engine.

16 Claims, 2 Drawing Sheets

(56) References Cited

U.S. PATENT DOCUMENTS

| | | | | |
|---|---|---|---|---|
| 6,032,869 | A * | 3/2000 | Ito et al. | 237/12.3 B |
| 6,899,162 | B2 * | 5/2005 | Hohl et al. | 165/41 |
| 6,955,141 | B2 | 10/2005 | Santanam et al. | |
| 7,966,978 | B2 * | 6/2011 | Maehara et al. | 123/41.29 |
| 2002/0043223 | A1 | 4/2002 | Gregory | |
| 2002/0069839 | A1 | 6/2002 | Kunze et al. | |
| 2002/0195067 | A1 * | 12/2002 | Murakami et al. | 123/41.1 |
| 2004/0237911 | A1 * | 12/2004 | Sano | 123/41.1 |
| 2006/0005790 | A1 * | 1/2006 | Braun et al. | 123/41.08 |
| 2006/0096553 | A1 | 5/2006 | Takahashi | |
| 2007/0137592 | A1 * | 6/2007 | Hanai | 123/41.14 |
| 2009/0094707 | A1 | 4/2009 | Cirpus | |
| 2009/0205590 | A1 * | 8/2009 | Vetrovec | 123/41.14 |
| 2009/0301414 | A1 * | 12/2009 | Netsu | 123/41.72 |
| 2010/0162971 | A1 * | 7/2010 | Kormann et al. | 123/41.01 |

FOREIGN PATENT DOCUMENTS

| | | | |
|---|---|---|---|
| EP | 0442489 | A1 | 8/1991 |
| FR | 2849673 | A1 | 7/2004 |
| KR | 20080054139 | A | 6/2008 |
| WO | 2008029029 | A1 | 3/2008 |

* cited by examiner

LIQUID-COOLED INTERNAL COMBUSTION ENGINE AND METHOD FOR OPERATING AN INTERNAL COMBUSTION ENGINE OF SAID TYPE

RELATED APPLICATIONS

The present application claims priority to German Patent Application No. 102012200003.8, filed on Jan. 2, 2012, the entire contents of which are hereby incorporated by reference.

FIELD

This disclosure relates to an internal combustion engine with liquid cooling.

BACKGROUND

Engine cooling systems can have an air-type cooling arrangement or a liquid-type cooling arrangement. Due to the higher heat capacity of liquids, however, it is possible for significantly greater quantities of heat to be dissipated using a liquid-type cooling arrangement than is possible using an air-type cooling arrangement. Therefore, internal combustion engines are frequently equipped with a liquid-type cooling arrangement to accommodate ever increasing engine thermal loads. For example, it is common for internal combustion engines to include a supercharger coupled to the engine system that is densely packaged in the engine compartment. This results in an ever greater number of components being integrated into the cylinder head or cylinder block, and further increases the thermal loading of the internal combustion engine.

In a liquid-type cooling arrangement the cylinder head is equipped with at least one coolant jacket, including coolant ducts to circulate the coolant through the cylinder head. In this arrangement, the heat is discharged to the coolant in the interior of the cylinder head surface, and therefore does not have to first be conducted to the cylinder head surface in order to be dissipated, as is the case in an air-type cooling arrangement. The heat which is discharged to the coolant is thereby extracted from the coolant again outside the cylinder head, for example by a heat exchanger and/or in some other way as it is circulated throughout the coolant system by a pump arranged in the coolant circuit. In a similar manner, the cylinder block may also have one or more coolant jackets that allow heat to be discharged to the coolant as it flows through the cylinder block. To form a coolant circuit, the outlet-side discharge openings via which coolant is discharged from the coolant jackets are connected to the inlet-side supply openings which serve for the feed of coolant via a recirculation line.

To reduce the friction losses and thus the fuel consumption of an internal combustion engine, fast heating of the engine oil, in particular after a cold start, may be advantageous. Fast heating of the engine oil during the warm-up phase of the internal combustion engine ensures a correspondingly fast decrease in the viscosity of the oil and thus a reduction in friction and friction losses, in particular in the bearings which are supplied with oil, for example the bearings of the crankshaft.

Methods and concepts are known wherein the friction losses are reduced by fast heating of the engine oil. For example, the oil may be actively heated by an external heating device. However, a heating device is an additional consumer of fuel, which opposes a reduction in fuel consumption. Other example concepts provide that the engine oil heated during operation be stored in an insulated vessel and utilized upon a restart, but the oil heated during operation cannot be held at a high temperature for an unlimited amount of time, which is problematic. In yet another example, during the warm-up phase, a coolant-operated oil cooler may be utilized, contrary to its intended purpose, for heating the oil.

In order to reduce friction losses, fast heating of the engine oil may also occur in response to the fast heating of the internal combustion engine itself, which in turn is assisted, or forced, by extracting as little heat as possible from the engine during the warm-up phase. In this respect, the warm-up phase of the internal combustion engine after a cold start is an example of an operating mode in which it is advantageous for as little heat as possible, and preferably no heat, to be extracted from the internal combustion engine. Therefore, control of the liquid-type cooling arrangement in which the extraction of heat after a cold start is reduced for the purpose of fast heating of the internal combustion engine may be realized through the use of a temperature-dependent self-controlling valve, often referred to as a thermostat valve.

In an internal combustion engine which has both a liquid-cooled cylinder head and a liquid-cooled cylinder block, it is advantageous for the flow of coolant through the cylinder head and the cylinder block to be controlled independently of one another, in particular because the two engine components are thermally loaded to different degrees and exhibit different warm-up behavior. In this regard, it may be advantageous for the coolant flow through the cylinder head and the coolant flow through the cylinder block to be controlled in each case by a dedicated thermostat valve.

The German laid-open specification DE 100 61 546 A1 describes a cooling system for an internal combustion engine, which is cooled by liquid coolant, and wherein the amounts of coolant which flows firstly through coolant ducts of a cylinder head and secondly through coolant ducts of a cylinder block are predefined. Therein, the thermostat valve of the cylinder head has a lower opening temperature than the thermostat valve of the cylinder block, which are both positioned downstream of the engine components. This method, however, requires two shut-off elements or thermostat valves and therefore increases the system costs, the space required and the overall weight of the engine system. A further disadvantage is that the circulation of the coolant in the cooling circuit cannot occur in a targeted manner, even after a cold start of the internal combustion engine. For example, after a cold start, coolant is conducted through both the cylinder head and also through the cylinder block, although the coolant flow through the cylinder block is reduced to a small leakage flow.

Herein, the inventors have recognized that control of a liquid-type cooling system is sought wherein the amount of circulating coolant can be reduced after a cold start in a targeted manner and that further allows thermal management of the internal combustion engine as it heats up to operating temperatures. Therefore, herein a self-controlling thermostat valve is described having an invariant, component-specific operating temperature suitable for all load states, and which has an opening temperature configured for high thermal loads, which is comparatively low and leads to relatively low coolant temperatures even in partial-load operations.

For example, different coolant temperatures may be advantageous for different load states because the heat transfer in a cylinder head or cylinder block is determined by the amount of coolant flowing therein, in addition to the temperature difference between the engine component and the coolant. Thus, a relatively high coolant temperature in partial-load operation is substantially equivalent to a small temperature difference between the coolant and the cylinder head or cylinder block. The result is a reduced heat transfer at low and medium loads, which increases the thermal efficiency in partial-load operations.

The inventors have further recognized that the purpose of a liquid-type cooling arrangement is not to extract the greatest amount of heat from the internal combustion engine under all operating conditions. Rather, what is sought is a demand-dependent control of the liquid-type cooling arrangement, which aside from full load also makes allowance for the operating modes of the internal combustion engine in which it is more advantageous for less heat, or as little heat as possible, to be extracted from the internal combustion engine.

Therefore, according to one example aspect of the disclosure, an internal combustion engine having a control arrangement for the liquid-type cooling circuit in which both the coolant flow through the cylinder head and through the cylinder block is controlled at the outlet side by a single setting element, or adjustable control valve is described. Since a single control unit containing a thermostat valve is used instead of two thermostat valves, advantages are offered with respect to cost reduction, weight and the space required for inclusion in the coolant circuit. Another advantage is that the number of components in the engine system is also reduced, which may further reduce the procurement costs and assembly costs of the engine system, and thereby shorten the assembly time.

Within the context of the present disclosure, the expression "internal combustion engine" encompasses diesel engines and spark-ignition engines and also hybrid internal combustion engines. It should also be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
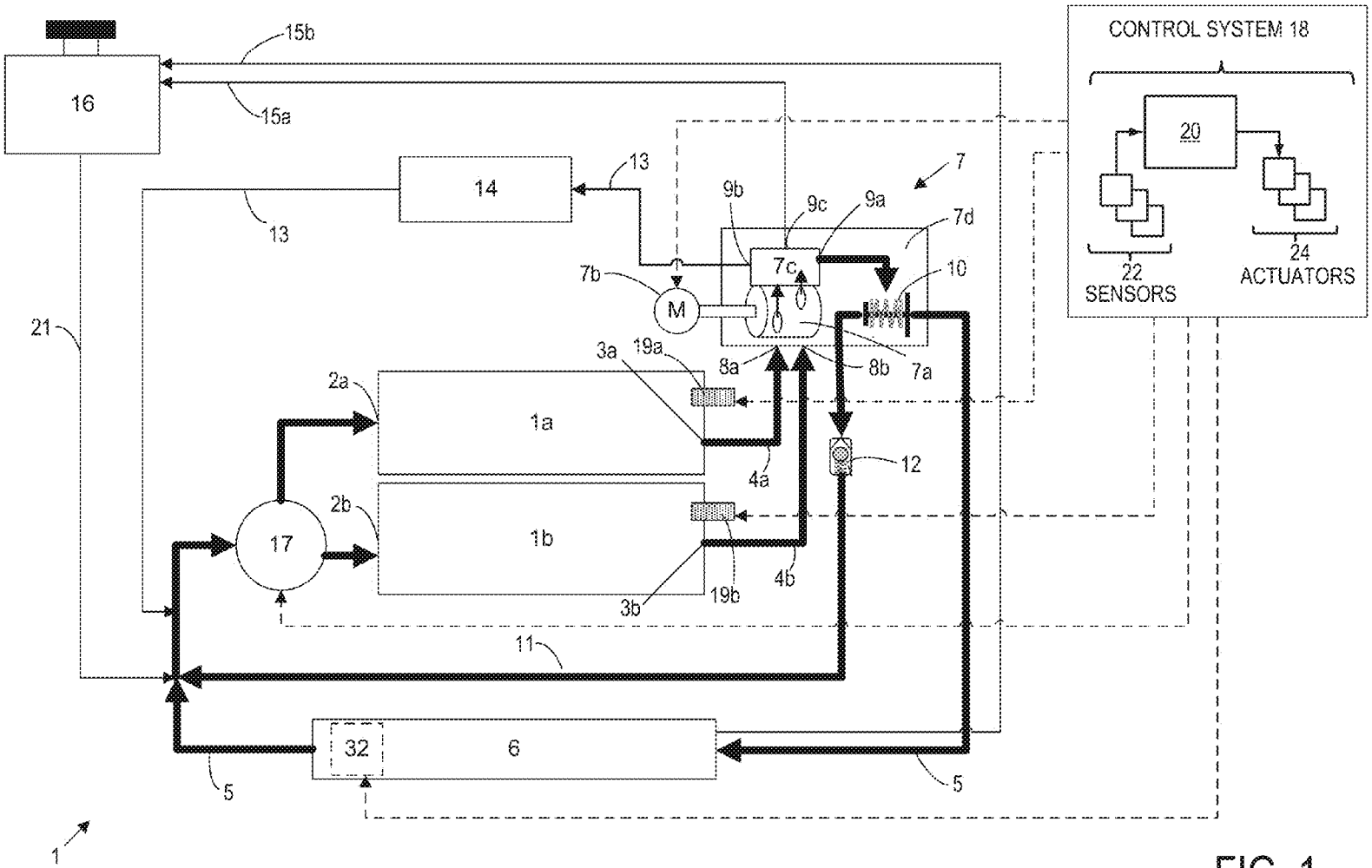
FIG. 1 shows an example schematic diagram of a cooling system including a single coolant control device capable of adjusting flow within the cooling system.
Figure 2:
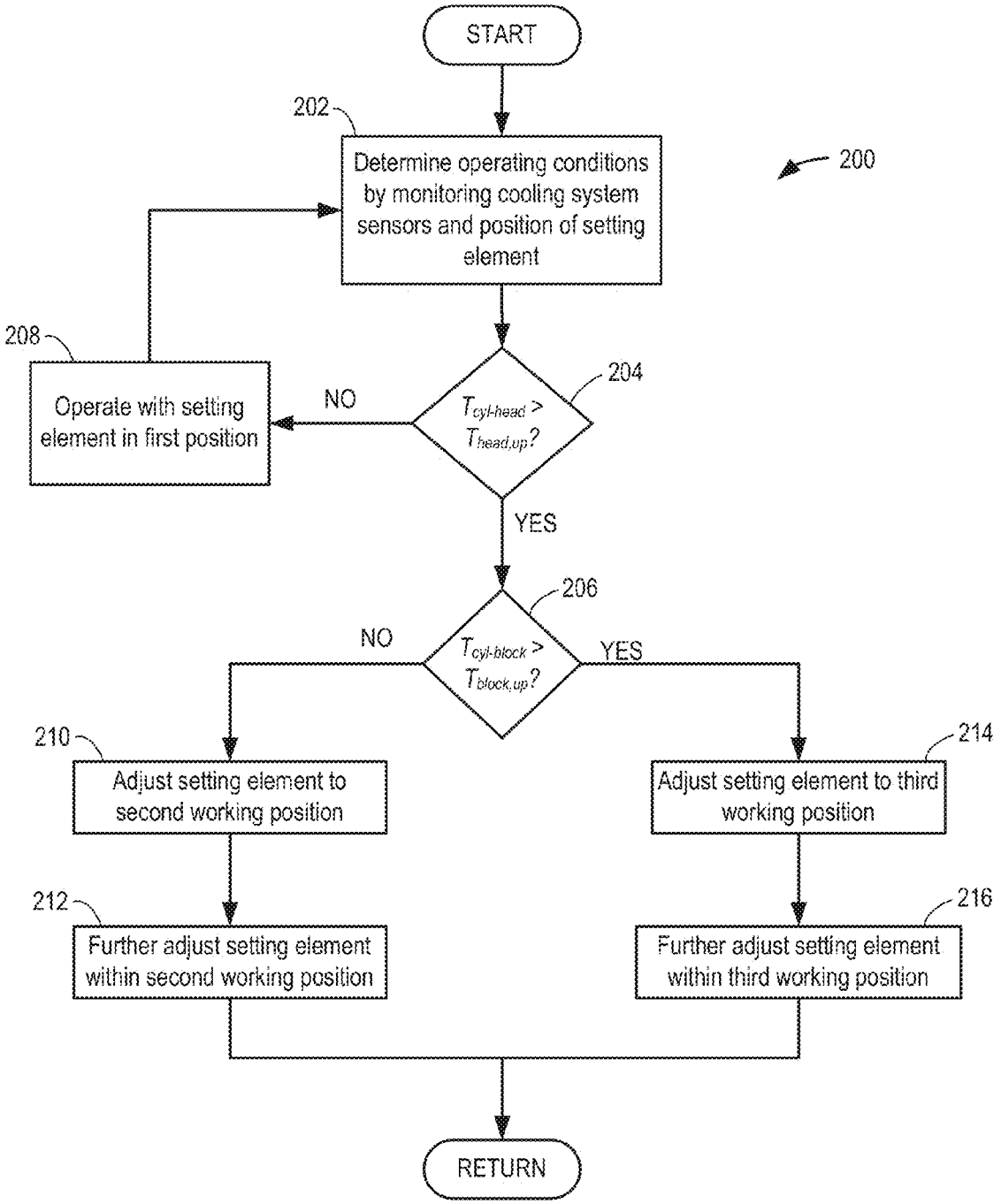
FIG. 2 is a flow chart illustrating a method for switching between valve positions of the adjustable control element according to one embodiment of the disclosure.

A method for operating a liquid-cooled internal combustion engine having at least one cylinder head and one cylinder block is described, wherein the method includes a coolant control device capable of adjusting the flow of coolant through an engine system in order to thermally manage the engine during warm-up operations. An exemplary system is shown in FIG. 1 that includes a schematic diagram of a cooling system having a single coolant control device and wherein arrows indicate the flows of coolant through the cooling system. FIG. 2 then shows a flow chart illustrating a method by which the controller may adjust the flow of coolant based on temperatures measured within the engine system.

FIG. 1 schematically shows internal combustion engine 1 comprised of cylinder head 1*a* and a cylinder block 1*b*. The internal combustion engine 1 is equipped with a liquid-type cooling arrangement, wherein cylinder head 1*a* has a first integrated coolant jacket with a first supply opening 2*a* at the inlet side to deliver the coolant to the coolant jacket and a first discharge opening 3*a* at the outlet side to discharge coolant therefrom. Likewise, cylinder block 1*b* has a second integrated coolant jacket that includes a second supply opening 2*b* at the inlet side to deliver coolant to the coolant jacket and a second discharge opening 3*b* at the outlet side for the discharge of coolant.

To form a coolant circuit, the outlet-side discharge openings 3*a* and 3*b* are shown connected to the inlet-side supply openings 2*a* and 2*b* via recirculation line 5, which also contains heat exchanger 6. Pump 17 is provided at the inlet side for delivering coolant to cylinder head 1*a* and cylinder block 1*b*. When active, pump 17 may circulate fluid throughout the system in the manner described below. Further, if the pump is variably controllable, it is possible for the coolant flow to be influenced by a delivery pressure.

A control unit 7 having a single setting element 7A is provided at the outlet side to control the flow of coolant through cylinder head 1*a* and cylinder block 1*b*. Said control unit 7 has two inlets 8*a* and 8*b*, wherein the first inlet 8*a* is connected via a line portion 4*a* to the first discharge opening 3*a* of the first coolant jacket, and wherein the second inlet 8*b* is connected via a line portion 4*b* to the second discharge opening 3*b* of the second coolant jacket. Setting element 7*a* includes a rotatable drum that rotates about its longitudinal axis and which is actuated by an electric motor 7*b* coupled to engine control system 18. For example, control system 18 may communicate with the flow control unit 7 in such a way that the flow through cylinder head 1*a* and through cylinder block 1*b* can be adjusted based on temperatures within the engine system. For this purpose, the drum has bores via which the inlets 8*a* and 8*b* can be connected to a distributor chamber 7*c* situated downstream of setting element 7*a*.

In one embodiment, setting element 7*a* may be adjusted in response to a signal from control system 18 as a function of a cylinder head temperature, $T_{cyl.-head}$, and/or a cylinder block temperature, $T_{cyl.-block}$. For this reason, a sensor 19*a* to determine $T_{cyl.-head}$ is provided on cylinder head 1*a* and a sensor 19*b* to determine $T_{cyl.-block}$ is provided on cylinder block 1*b*. When setting element 7*a* resides in a first position, also called the rest position, the drum may be positioned so inlets 8*a* and 8*b* are blocked. Therefore, the flow of coolant is interrupted through both cylinder head 1*a* and cylinder block 1*b*. For example, the flow of coolant through both engine components may be interrupted during the warm-up phase after a cold start when it is advantageous for as little heat as possible to be extracted from the engine components.

By moving setting element 7*a* into a second working position, the first inlet 8*a*, which is connected to the coolant jacket of cylinder head 1*a*, is opened up while the second inlet 8*b* remains blocked. The second working position is suitable for the warm-up phase of the internal combustion engine. Therefore, the coolant may circulate through cylinder head 1*a*, which is thus continuously cooled, and thereby allow for the fact that the cylinder head is thermally highly loaded and heats up relatively quickly, while the coolant flow through cylinder block 1*b* remains blocked. Furthermore, the first inlet can be modulated to a greater or lesser extent by further adjusting setting element 7*a* within the second working position to adjust the flow rate, which thus provides a device to control the amount of heat extracted from the cylinder head. As such, in one embodiment, it is possible for the liquid-type cooling arrangement of an internal combustion engine according to the disclosure to be designed in such a way that the setting element may be switched between different positions, and then further rotated. That is, the setting element may be switched from one position into another position in stages and then further modulated based on measured temperatures within the engine system.

Further rotation of the drum, or setting element 7*a*, into a third working position also opens up the second inlet 8*b* and thereby allows the coolant to circulate through cylinder block 1*b* in addition to cylinder head 1*a*. In the manner already described above with respect to the first inlet, the second inlet can also be opened to a greater or lesser extent to adjust the setting element within the second working position. As a result, the flow rate and thus the amount of heat extracted from the cylinder block is adjustable. The adjustment of setting element 7*a* is preferably performed as a function of a determined cylinder head temperature $T_{cyl.-head}$ and/or cylinder block temperature $T_{cyl.-block}$. In this way, it is possible for both the cylinder head and also the cylinder block to be temperature-controlled or cooled according to demand.

As described above, embodiments of the internal combustion engine are advantageous in which the setting element is continuously adjustable in such a way that, in the second and third working positions, the flow through the cylinder head and cylinder block, respectively, can be fine-tuned. Therefore, the liquid cooling device is designed in such a way that the setting element can be switched between different positions, and then further adjusted therein. To accomplish the adjustable flow described, the control system 18 may simply direct electric motor 7*b* to further rotate the drum and thereby open an inlet to a greater or lesser extent. In this way, it is possible to regulate the coolant quantity which flows through the cylinder head and/or the cylinder block, and thus the amount of heat dissipated by the coolant.

Control unit 7 and thermostat valve 10 are accommodated in common housing 7*d*, in the embodiment described herein and shown in FIG. 1. This is advantageous since a single unit permits a denser packaging in the engine system, and thereby simplifies its assembly.

The distributor chamber 7*c* is located downstream of setting element 7*a* and serves to distribute the coolant to three outlets identified at 9*a*, 9*b*, and 9*c*. However, the distributor may generally have a chamber which serves for the distribution of coolant to at least two outlets. In FIG. 1, the first outlet 9*a* is shown connected to the recirculation line 5, which contains a self-controlling thermostat valve 10 arranged upstream of heat exchanger 6. In some embodiments, the recirculation line may not be a line in the physical sense but rather may also be integrated in portions into the cylinder head, the cylinder block or some other component. A heat exchanger is provided in the return line, which heat exchanger extracts heat from the coolant again. The self-controlling valve has a temperature-reactive element which is impinged on by coolant. Said thermostat valve 10 may block the recirculation line 5 and instead connect the first outlet 9*a* to a bypass line 11, which bypasses the heat exchanger 6 if the coolant temperature, $T_{coolant}$, is lower than a predefined coolant temperature, $T_{coolant-threshold}$. When this condition is met, the flow of coolant bypasses heat exchanger 6 since no additional heat needs to be extracted from the circulating fluid. The bypass line 11, which opens into the recirculation line 5 again at the inlet side, also contains an overpressure valve 12. Conversely, if the predefined coolant temperature is exceeded, thermostat valve 10 may open recirculation line 5 and thereby direct the flow of coolant to heat exchanger 6 instead of through bypass line 11. The thermostat valve thus ensures that coolant passes through the heat exchanger and is cooled when the coolant temperature $T_{coolant}$, exceeds a predefinable coolant temperature $T_{coolant-threshold}$. With regard to the efficiency of the internal combustion engine, it is advantageous for as little heat as possible to be extracted from the internal combustion engine or from the coolant during operation.

In addition, a reduction of the dissipation of heat by convection is realized primarily through the bypassing of a coolant cooler arranged in the circuit, wherein the coolant conducted through the cylinder head is not conducted through the cooler in any switching state of the thermostat valves, and the coolant of the cylinder block is conducted through the cooler once the opening temperature of the associated thermostat valve is reached. By contrast, if during the start of the warm-up phase, the coolant did not flow but rather was stationary in the circuit, the warming of the coolant and the heating of the internal combustion engine would be further accelerated. Such control would additionally promote the warming of the engine oil and further reduce friction losses.

Embodiments of the internal combustion engine are advantageous in which the heat exchanger 6 provided in the recirculation line is equipped with fan 32. Fan 32 may be driven by a fan motor which drives a fan impeller to set the latter in rotation and may further provide an adequately large mass flow of air to the heat exchanger to fundamentally assist the heat transfer, in all operating states, but in particular when the motor vehicle is stationary and at low vehicle speeds. The fan motor is generally an electrically operated piece of equipment that can be controlled in a continuously variable manner with different loads or rotational speeds.

To form a heating circuit, feed line 13 branches off from the second outlet 9*b* of control unit 7. Arranged in feed line 13, which opens into the recirculation line 5 downstream of the heat exchanger 6 and upstream of pump 17 at the inlet side, there is a heater 14 which may be operated with coolant and by which the air supplied to the passenger compartment of a vehicle can be heated. For example, heat can be extracted from the coolant after it flows through the cylinder head or cylinder block by a heat exchanger which serves as a cooler. In the present embodiment, a heater is provided which is operated with coolant and which utilizes the heated coolant to heat the air supplied to the passenger compartment of the vehicle, as a result of which the temperature of the coolant is reduced. In some embodiments, the feed line may also include a shut-off element which serves for the activation and deactivation of the heater.

A ventilation line 15*a* connects the third outlet 9*c* of control unit 7 to a ventilation tank 16, which is also connected to another ventilation line 15*b* that connects heat exchanger 6 to said ventilation tank 16. Ventilation tank 16 is further connected to the recirculation line 5 at the inlet side via a return line 21.

It is advantageous for the setting element to be controlled by an engine controller. Modern internal combustion engines generally have an engine controller, and it is therefore advantageous to utilize said controller for actuating or controlling the setting element. The various components described above may be controlled by a vehicle control system 18, which includes a controller 20 with computer readable instructions for carrying out routines and subroutines for regulating vehicle systems, a plurality of sensors 22, and a plurality of actuators 24. For example, the engine controller may store characteristic maps which can be used for characteristic-map-controlled cooling. It is then possible to reduce the coolant flow after a cold start in order to accelerate heating and thereby influence the thermal management of the internal combustion engine in a characteristic-map-specific manner. In particular, different coolant temperatures may be realized for different load states. Furthermore, control system 18 may store operating parameters that have already been determined for other purposes but which can be used to control the amount of cooling within the system.

As for the coolant, use is generally made of a water-glycol mixture provided with additives. In relation to other coolants, water has the advantage that it is non-toxic, readily available and cheap, and furthermore has a very high heat capacity, for which reason water is suitable for the extraction and dissipation of very large amounts of heat, which is generally considered to be advantageous.

The internal combustion engine 1 includes a method for operating a liquid-cooling system of the type described above. FIG. 2 therefore illustrates method 200 for switching between valve positions of the adjustable control element according to one embodiment of the disclosure. In particular, the method includes a device, such as a driver, to actuate a control element based on operating parameters of the internal combustion engine. Whereas, self-controlling thermostat valves characterized by a fixed, or invariant opening temperature, are commonly used, herein an actively controlled shut-off element is disclosed, wherein said active control may be performed for example by an engine controller. Based on the method described, it is also possible to realize characteristic-map-controlled actuation of the control element, and thus to control the temperature of the coolant based on the present load state of the internal combustion engine. For example a higher coolant temperature may be used at low loads than at high loads. The controller may therefore adjust a control element to control the flows of coolant through the cylinder head and the cylinder block in order to adjust the amount of heat extracted according to demand.

An internal combustion engine which is designed in the manner described is advantageous in particular during the warm-up phase directly after a cold start. After the vehicle has been at a standstill for a period of time, that is to say upon a restart of the internal combustion engine, the cooling of the cylinder head and of the cylinder block remains deactivated as a result of both inlets being closed. Therefore, when the setting element is in the rest position, coolant does not flow, but rather is stationary in the coolant jackets of the cylinder head and cylinder block. The warming of the coolant and the heating of the internal combustion engine is thus accelerated further and such control also accelerates the warming of the engine oil, which results in lowering of the friction losses of the internal combustion engine and a corresponding decrease in fuel consumption.

At box 202, method 200 includes determining the operating conditions by monitoring sensors within the cooling system. For example, control system 18 may receive signals from temperature sensors 19*a* and 19*b* coupled to cylinder head 1*a* and cylinder block 1*b*, respectively. Control system 18 may further receive signals from control unit 7 to determine the position of setting element 7*a* within the control unit. Then, based on temperatures detected within each engine component, the control system may direct electric motor 7*b* to adjust the flow of coolant throughout the cooling system. For example, embodiments of the internal combustion engine are advantageous in which the setting element, when in a rest position, blocks the two inlets of the control unit such that the coolant circuit is blocked both through the cylinder head and also through the cylinder block. Because the cylinder head may heat up more quickly than the engine block during the warm-up phase after a cold start, the cylinder threshold may determine whether the setting element 7*a* is moved from a first position, that is the rest position, where circulation of fluid is blocked in both cylinder head 1*a* and cylinder block 1*b*, to a second working position where circulation through cylinder head 1*a* is allowed but circulation through cylinder block 1*b* is simultaneously blocked.

At box 204, control system 18 may sense the temperature within cylinder head 1*a*, $T_{cyl\text{-}head}$, using sensor 19*a* and further compare the value measured to a cylinder threshold, $T_{head,up}$. If $T_{cyl.\text{-}head}$ is greater than the cylinder threshold, box 206 indicates that control system 18 may further sense the temperature within cylinder block 1*b*, $T_{cyl.\text{-}block}$, using sensor 19*b* and compare the value measured therein to a cylinder block threshold, $T_{block,up}$. When taken together, these temperature measurements allow the control system to determine the optimal position of setting element 7*a* based on temperatures measured within the engine system. Then, after the position of the setting element has been determined, control system 18 can direct the electric motor 7*b* to adjust the position of setting element 7*a* in order to circulate coolant optimally throughout the cooling system. While the temperature of the cylinder head is below the cylinder threshold $T_{cyl.\text{-}head}$, box 208 indicates that the engine may continue operating with the setting element in the first position and continue to monitor the operating conditions.

Alternatively, embodiments of the internal combustion engine are advantageous in which the setting element is adjusted when the determined cylinder head temperature $T_{cyl.\text{-}head}$ exceeds a predefinable temperature threshold $T_{head,up}$, or where $T_{cyl.\text{-}head} \geq T_{head,up}$. Said threshold temperature may be a characteristic-map-specific temperature, that is to say may vary for different load states. Herein, control arrangements are advantageous in which the setting element is adjusted when the cylinder head temperature $T_{cyl.\text{-}head}$ exceeds the predefinable temperature threshold $T_{head,up}$ for a predefinable time period $\Delta t_{up}$. The introduction of an additional condition is intended to prevent premature actuation of the setting element if the cylinder head temperature $T_{cyl.\text{-}head}$ briefly exceeds a predefinable temperature threshold $T_{head,up}$ and then falls again or fluctuates around the predefined threshold temperature, which the control system can be programmed to account for. Therefore, the control system can generally be calibrated to adjust setting element 7*a* to the second working position and thereby allow coolant to circulate through cylinder head 1*a* while simultaneously blocking the flow of coolant through cylinder block 1*b*. While $T_{cyl.\text{-}head}$ is greater than $T_{head,up}$ and $T_{cyl.\text{-}block}$ is less than $T_{block,up}$, box 210 shows that the control system may adjust setting element 7*a* to a second working position. Box 212 shows that the flow of coolant through cylinder head 1*a* may be further adjusted within the second working position in the manner described above by rotating the drum to open an inlet of the control unit to a greater or lesser extent.

In another embodiment, the setting element can be actuated as a function of another operating parameter, for instance the temperature of a different engine component within the same engine system. For example, the setting element may be actuated as a function of the exhaust-gas temperature, which is often used as an indication of enrichment, and in turn serves to prevent overheating of the internal combustion engine, that is to say for limiting the cylinder head temperature $T_{cyl.\text{-}head}$. Regardless of method, embodiments of the internal combustion engine are advantageous in which the setting element is somehow adjustable as a function of a determined cylinder head temperature $T_{cyl.\text{-}head}$. Therefore, in method 200, the cylinder head temperature $T_{cyl.\text{-}head}$, is used as an input or regulating variable for the control or regulation of the cooling arrangement.

In yet another example embodiment, adjustments of setting element 7*a* may occur as a function of a determined cylinder head temperature $T_{cyl.\text{-}head}$, wherein the temperature $T_{cyl.\text{-}head}$ of the cylinder head is determined by calculation. For example, the mathematical determination of the cylinder head temperature $T_{cyl.-head}$ can be determined by simulation, which use known dynamic heat and kinetic models to determine the reaction heat generated during combustion. Therefore, the cylinder block temperature $T_{cyl.-block}$ may be taken into consideration for determining the cylinder head temperature $T_{cyl.-head}$ or, conversely, the cylinder head temperature $T_{cyl.-head}$ may be used for determining the cylinder block temperature $T_{cyl.-block}$. As input signals for the simulation, use is preferably made of operating parameters which are already available within the engine system, including those that have been determined for other purposes. The advantage of using simulations to calculate temperatures within the engine system is that no additional components, in particular sensors, have to be included in the liquid-cooling system, which is expedient with regard to costs. However, simulations may produce an approximate value that simply represents an estimated value of, for example, the cylinder head temperature and therefore may reduce the quality of the control or cooling system. Therefore, embodiments of the internal combustion engine in which a sensor is provided for determining temperatures within the system may offer numerous advantages compared to those where temperatures are simulated. Furthermore, detection of the cylinder head temperature can be adequately measured because the cylinder head exhibits relatively moderate temperatures even when the internal combustion engine has warmed up. In addition, numerous possibilities or locations exist for the arrangement of the sensor relative to the cylinder head.

Alternatively, in yet another embodiment, it is possible for the cylinder head temperature $T_{cyl.-head}$ to be determined, or estimated, using the temperature of the coolant. However, such a system may also include a sensor in the cooling circuit or coolant jacket of the cylinder head.

In a similar manner to the description provided with respect to $T_{cyl.-head}$, upon heating up during the warm-up phase, once $T_{cyl-block}$ reaches $T_{block,up}$, box 214 shows that the control system may adjust setting element 7*a* to the third working position and thereby allow coolant to circulate through both cylinder head 1*a* and cylinder block 1*b*. Box 216 further shows that the flow of coolant through cylinder head 1*a* may be adjusted within the third working position by rotating the drum to open an inlet of the control unit to a greater or lesser extent. In one example embodiment, the cylinder block threshold temperature $T_{block,up}$ is higher than the cylinder head temperature $T_{head,up}$, that is to say $T_{block,up}>T_{head,up}$.

The subject matter of the present disclosure includes all novel and non-obvious combinations and sub-combinations of the various systems and configurations, and other features, functions, and/or properties disclosed herein.

The invention claimed is:

1. An engine comprising: at least one cylinder head and one cylinder block, the cylinder head and the cylinder block both including at least one integrated coolant jacket with an supply opening and an outlet, a discharge opening, a coolant circuit being formed by coupling the discharge opening to the supply opening via a first recirculation line, which includes at least including a heat exchanger and a housing that includes a control unit, the control unit including a setting element, a first inlet coupled to the cylinder head discharge opening, and a second inlet coupled to the cylinder block discharge opening, wherein the housing includes an outlet.

2. The system of claim 1, wherein the control unit has a chamber which serves to distribute coolant to a first outlet and a second outlet, the first and second outlets located downstream of the setting element, and wherein the first inlet is coupled to the coolant jacket of the cylinder head and the second inlet is coupled to the coolant jacket of the cylinder block.

3. The system of claim 2, wherein the second outlet of the control unit is coupled to a heating circuit that comprises a feed line and a second recirculation line at an inlet side downstream of the heater, the heater being operated with coolant.

4. The system of claim 3, wherein the first recirculation line includes a self-controlling valve upstream of the heat exchanger, the self-controlling valve having a temperature-reactive element impinged on by coolant capable of blocking the first recirculation line, and wherein the first outlet is coupled to a bypass line which bypasses the heat exchanger based on a measured coolant temperature.

5. The system of claim 4, wherein the control unit and the self-controlling valve are accommodated in a common housing.

6. The system of claim 5, wherein the heat exchanger is equipped with a fan.

7. The system of claim 6, wherein a pump for delivering coolant is provided at the inlet side.

8. A method, comprising:

positioning a valve in a first valve position that blocks all coolant flow out of both a cylinder head and a cylinder block, positioning the valve in a second valve position that blocks only all coolant flow from the cylinder block and regulates variable coolant flow from the cylinder head; and positioning the valve in a third valve position that flows coolant from both the cylinder head and cylinder block.

9. The method of claim 8 wherein the second valve position is between the first and the third valve positions.

10. The method of claim 8 wherein within a third range, the valve regulates flow from the cylinder block while maintaining flow through the cylinder head.

11. The method of claim 8 further comprising adjusting the valve among first, second, and third ranges based on temperature.

12. The method of claim 11 further comprising adjusting the valve within and throughout the second range based on temperature.

13. The method of claim 12 further comprising adjusting the valve within and throughout the third range based on temperature.

14. The method of claim 8 wherein the valve comprises a rotatable body with variably positioned passages.

15. A method, comprising:

operating a liquid-cooling system in which a coolant control device with an adjustable control element that has at least three working positions, including:

a first position that blocks a flow of coolant through both a cylinder head and a cylinder block, and a second position that allows the flow of coolant through a cylinder head while blocking the flow through a cylinder block, and a third position that allows the flow of coolant through both the cylinder head and cylinder block, wherein the adjustable control element is controlled by a control system in response to a temperature within an engine system, and wherein the adjustable control element is a drum with inlet bores to allow a coolant flow to be targeted based on demand, the drum being rotatable around a longitudinal axis to adjust its position in such a way that the control element is continuously adjustable within a working position by opening an inlet to a greater or lesser extent in order to further adjust the flow of coolant flow through the coolant circuit.

16. The method of claim 15, wherein at least one sensor is provided for determining the cylinder head and cylinder block temperatures, and wherein the adjustable control element is adjusted in response to at least a measured cylinder head temperature compared to a threshold, and a cylinder block temperature compared to a different threshold.

* * * * *